US010800014B2

(12) United States Patent
Seith et al.

(10) Patent No.: US 10,800,014 B2
(45) Date of Patent: Oct. 13, 2020

(54) LOW-PROFILE IMPACT TOOLS

(71) Applicant: Ingersoll-Rand Industrial U.S., Inc., Davidson, NC (US)

(72) Inventors: Warren A. Seith, Bethlehem, PA (US); Mark T. McClung, Andover, NJ (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 198 days.

(21) Appl. No.: 15/830,478

(22) Filed: Dec. 4, 2017

(65) Prior Publication Data

US 2018/0085900 A1 Mar. 29, 2018

Related U.S. Application Data

(62) Division of application No. 13/832,305, filed on Mar. 15, 2013, now Pat. No. 9,833,885.

(51) Int. Cl.

| | |
|---|---|
| ***B25B 21/02*** | (2006.01) |
| ***B25B 21/00*** | (2006.01) |
| ***B25B 13/48*** | (2006.01) |
| *B25F 5/02* | (2006.01) |

(52) U.S. Cl.

CPC ..... *B25B 21/02* (2013.01); *B25B 13/481* (2013.01); *B25B 21/002* (2013.01); *B25B 21/00* (2013.01); *B25F 5/02* (2013.01)

(58) Field of Classification Search

CPC ..... B25B 17/00; B25B 21/00; B25B 21/002; B25B 21/02; B25B 21/004; B25B 21/005; B25B 21/026; B25B 13/463; B25B 13/481

USPC ..... 173/29, 216, 93, 93.5, 128, 217, 93.7, 173/109, 213; 81/57.13, 57.11, 57.26, 81/57.29, 463, 57.14, 57.39, 57.3

See application file for complete search history.

(56) References Cited

U.S. PATENT DOCUMENTS

| | | | | | |
|---|---|---|---|---|---|
| 2,119,968 | A * | 6/1938 | Shaff | B25B 21/004 | 81/57.39 |
| 2,179,724 | A * | 11/1939 | Kuehne | B25B 21/00 | 81/475 |
| 2,264,012 | A * | 11/1941 | Wasson | B25B 21/004 | 81/57.39 |
| 3,257,877 | A * | 6/1966 | Ulrich | B25B 21/002 | 81/57.13 |
| 3,535,960 | A * | 10/1970 | Borries | B25B 21/002 | 81/57.14 |
| 3,570,331 | A * | 3/1971 | Rogers | B25B 21/004 | 81/54 |
| 3,987,692 | A * | 10/1976 | Lesner | B25B 21/002 | 81/57.13 |
| 4,116,093 | A * | 9/1978 | DePagter | B25B 21/004 | 81/57.39 |

(Continued)

*Primary Examiner* — Scott A Smith
(74) *Attorney, Agent, or Firm* — Taft Stettinius & Hollister LLP

(57) ABSTRACT

Illustrative embodiments of impact tools are disclosed. In at least one illustrative embodiment, an impact tool comprises a motor including an output shaft configured to rotate about a first axis and a drive train configured to be driven by the output shaft of the motor and to drive rotation of an output drive about a second axis that is non-parallel to the first axis, wherein the drive train includes an impact mechanism comprising a hammer configured to rotate about a third axis to periodically deliver an impact load to an anvil, the third axis being parallel to and spaced apart from the second axis.

3 Claims, 2 Drawing Sheets

(56) References Cited

U.S. PATENT DOCUMENTS

| | | | | | |
|---|---|---|---|---|---|
| 4,171,651 | A * | 10/1979 | Dacunto | B25B 21/00 | 81/57.29 |
| 4,233,865 | A * | 11/1980 | Junkers | B25B 21/005 | 81/57.39 |
| 4,339,968 | A * | 7/1982 | Krieger | B25B 21/005 | 81/57.39 |
| 4,458,563 | A * | 7/1984 | Bickford | B25B 21/005 | 74/128 |
| 4,974,475 | A * | 12/1990 | Lord | B25B 21/00 | 81/57.13 |
| 5,142,952 | A * | 9/1992 | Putney | B25B 13/465 | 81/57 |
| 5,609,077 | A * | 3/1997 | Ohmi | B25B 13/481 | 81/57.13 |
| 6,260,443 | B1 * | 7/2001 | Spirer | B25B 13/463 | 81/57.3 |
| 6,502,485 | B1 * | 1/2003 | Salazar | B25B 13/463 | 173/93.7 |
| 7,836,797 | B2 * | 11/2010 | Hecht | B25B 21/00 | 81/57.14 |
| 8,499,853 | B2 * | 8/2013 | Spirer | B25B 21/005 | 173/213 |
| 8,925,646 | B2 * | 1/2015 | Seith | B25B 21/026 | 173/109 |
| 9,205,542 | B2 * | 12/2015 | Dedrickson | B25B 21/004 | |
| 9,266,226 | B2 * | 2/2016 | Timmons | B25B 21/02 | |
| 9,833,885 | B2 * | 12/2017 | Seith | B25B 21/02 | |

* cited by examiner

LOW-PROFILE IMPACT TOOLS

CROSS-REFERENCE TO RELATED APPLICATIONS

This application is a divisional of U.S. patent application Ser. No. 13/832,305, filed Mar. 15, 2013, now U.S. Pat. No. 9,833,885.

TECHNICAL FIELD

The present disclosure relates, generally, to impact tools and, more particularly, to low-profile impact tools.

BACKGROUND

Many power tools that are used for tightening and loosening fasteners have difficulty fitting in tight spaces. In particular, existing impact tools may not be able to reach certain fasteners due to the size and/or orientation of the tool head and the output drive. In contrast, many tools that do in tight spaces may not be able to accomplish tightening and loosening of fasteners effectively and/or safely.

SUMMARY

According to one aspect, an impact tool may comprise a motor including an output shaft configured to rotate about a first axis and a drive train configured to be driven by the output shaft of the motor and to drive rotation of an output drive about a second axis that is non-parallel to the first axis, wherein the drive train includes an impact mechanism comprising a hammer configured to rotate about a third axis to periodically deliver an impact load to an anvil, the third axis being parallel to and spaced apart from the second axis.

In some embodiments, the second axis and the third axis may be perpendicular to the first axis. The hammer may be configured to move axially along the third axis when the hammer rotates about the third axis. The impact mechanism may comprise a ball-and-cam-type impact mechanism.

In some embodiments, no portion of the drive train is positioned adjacent the output drive along the second axis. The output drive may be formed to include an opening extending entirely through the output drive along the second axis. The output drive may comprise an interchangeable hex insert.

In some embodiments, the output drive may comprise a ratcheting mechanism. The anvil may comprise a first strut having a first end and a second end opposite the first end, the first end being configured to be impacted by the hammer when the hammer rotates about the third axis in a first rotational direction and the second end being coupled to the ratcheting mechanism, such that the first strut causes rotation of the output drive about the second axis in the first rotational direction when the first strut is impacted by the hammer. The anvil may further comprise a second strut having a first end and a second end opposite the first end, the first end being configured to be impacted by the hammer when the hammer rotates about the third axis in a second rotational direction and the second end being coupled to the ratcheting mechanism, such that the second strut causes rotation of the output drive about the second axis in the second rotational direction when the second strut is impacted by the hammer.

In some embodiments, the anvil may be configured to rotate about the third axis when impacted by the hammer. An outer surface of the anvil may include gear teeth that mesh with an idler gear. The output drive may comprise an outer ring including gear teeth that mesh with the idler gear. The output drive may further comprise an interchangeable hex insert engaged with the outer ring. The output drive may be pivotable relative to the drive train such that the second axis is also positionable at an angle relative to the third axis. The gear teeth of the outer ring may remain meshed with the idler gear when the second axis is positioned at an angle relative to the third axis.

According to another aspect, an impact tool may comprise a motor including an output shaft configured to rotate about a first axis and a drive train including an impact mechanism, the drive train configured to be driven by the output shaft of the motor and to drive rotation of an output drive about a second axis that is non-parallel to the first axis, wherein the output drive is pivotable relative to the drive train such that the second axis is positionable at a plurality of angles relative to the first axis.

In some embodiments, the impact mechanism may comprise a hammer configured to rotate about a third axis to periodically deliver an impact load to an anvil, the third axis being perpendicular to the first axis. The output drive may be positionable such that the second axis is parallel to the third axis, the second axis being spaced apart from the third axis when parallel to the third axis. The output drive may be formed to include an opening extending entirely through the output drive along the second axis.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements. The detailed description particularly refers to the accompanying figures in which.

DETAILED DESCRIPTION OF THE DRAWINGS

Figure 1:
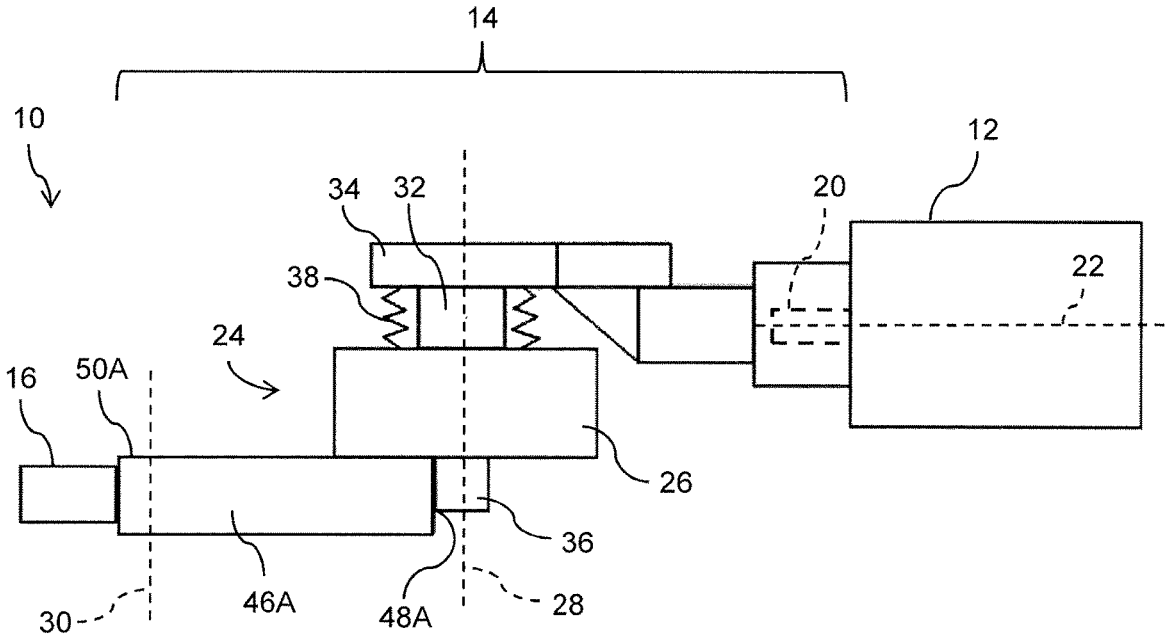
FIG. 1 illustrates a side view of a motor, a drive train, and an output drive of one embodiment of an impact tool.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Figure 2:
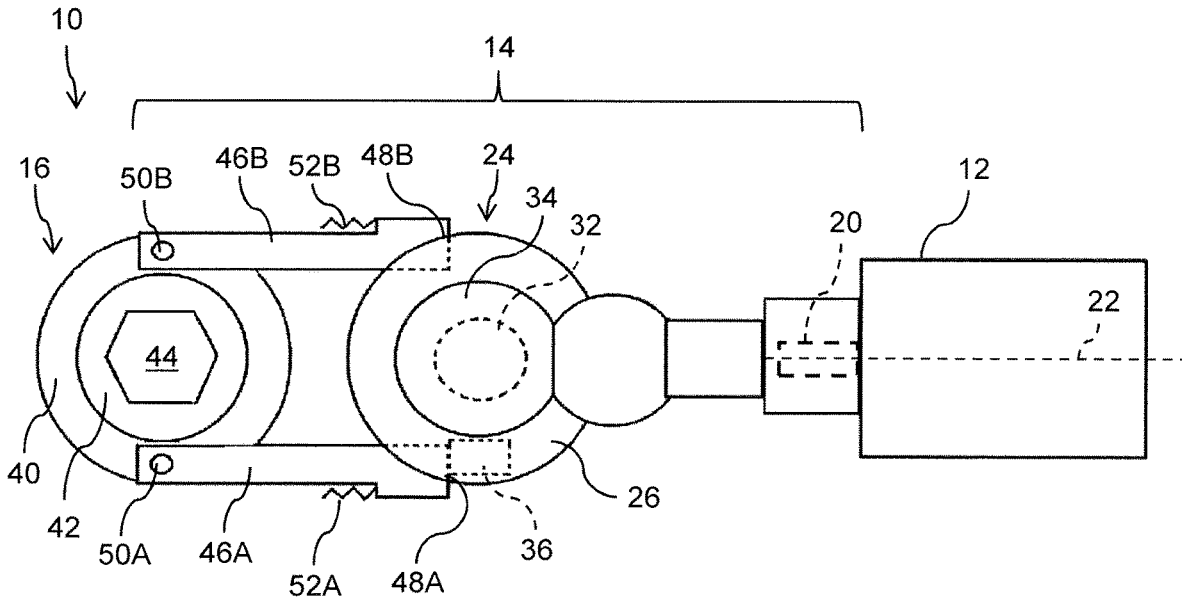
FIG. 2 illustrates a top view of the motor, the drive train, and the output drive of the impact tool of FIG. 1.

Referring now to FIGS. 1 and 2, simplified diagrams are shown of one illustrative embodiment of an impact tool 10. In particular, FIGS. 1 and 2 illustrate a motor 12, a drive train 14, and an output drive 16 of the impact tool 10. It will be appreciated that the impact tool 10 will generally include additional components (e.g., a housing supporting the motor 12, the drive train 14, and the output drive 16), which are not shown in FIGS. 1 and 2 for clarity of description. As shown in FIGS. 1 and 2, and further described below, the motor 12 includes an output shaft 20 that rotates about an axis 22, the drive train 14 includes an impact mechanism 24 having a hammer 26 that rotates about an axis 28, and the output drive 16 rotates about an axis 30. In the illustrative embodiment of the impact tool 10, the axis 30 is parallel to and spaced apart from the axis 28. Furthermore, in this illustrative embodiment, the axes 28, 30 are both perpendicular to the axis 22.

The motor 12 of the impact tool 10 may be embodied as any suitable prime mover. By way of illustrative example, the motor 12 may be an electric motor coupled to a source of electricity (e.g., mains electricity or a battery) or may be an air motor coupled to a source of pressurized fluid (e.g., an air compressor). The motor 12 includes an output shaft 20 that rotates about an axis 22 when the motor 12 is energized. In some embodiments, the axis 22 may be a longitudinal axis of the impact tool 10.

The drive train 14 of the impact tool 10 is coupled between the motor 12 and the output drive 16. When the drive train 14 is driven by the output shaft 20 of the motor 12, the drive train 14 in turn drives rotation of the output drive 16 about the axis 30 (allowing the output drive 16, in turn, to tighten or loosen a fastener). In the illustrative embodiment, the drive train 14 changes the axis of motion by ninety degrees, from the axis 22 to the axis 30. In other embodiments, the axis 30 may be oriented at another angle that is non-parallel to axis 22. The drive train 14 may include any number and/or types of devices suitable for transferring rotational motion of the output shaft 20 of the motor 12 to the output drive 16. By way of illustrative example, the drive train 14 may include one or more spur gears, one or more bevel gears, a planetary gear set, or any combination thereof. As described further below, the drive train 14 of the impact tool 10 includes the impact mechanism 24.

The output drive 16 of the impact tool 10 is configured to rotate about the axis 30 when driven by the drive train 14. The output drive 16 may be embodied as any device(s) suitable for transferring rotational motion of the output drive 16 to a fastener. As best seen in FIG. 2, the output drive 16 in the illustrative embodiment includes an outer ring 40 and a hex ring 42. The hex ring 42 includes an opening 44 extending entirely through the output drive 16 along the axis 30. This opening 44 allows the output drive 16 to be placed around a fastener, while also allowing a portion of the fastener to extend through the opening 44 along the axis 30. As shown in FIG. 1, no portion of the drive train 14 is positioned adjacent the output drive 16 along the axis 30 (i.e., above or below the opening 44 of the output drive 16). As such, a fastener (e.g., a bolt) of any size may extend through the opening 44 along the axis 30. The opening 44 formed in the hex ring 42 is generally sized to mate with the sides of a fastener. In some embodiments, the hex ring 42 may be embodied as an interchangeable hex insert 42 that engages the outer ring 40. In such embodiments, the impact tool 10 may include a plurality of interchangeable hex inserts 42, each having an opening 44 sized to mate with a different sized fastener.

In the illustrative embodiment of FIGS. 1 and 2, the output drive 16 includes a ratcheting mechanism coupling the outer ring 40 to the hex ring 42 (or interchangeable hex insert 42). This ratcheting mechanism allows the hex ring 42 to be driven in one rotational direction relative to the outer ring 40, but allows free movement of the hex ring 42 relative to the outer ring 40 in the other rotational direction. In some embodiments, the operation of the ratcheting mechanism (i.e., which rotational direction is driven) may be reversible, either automatically by the impact tool 10 or manually by a user. In other embodiments, in which the ratcheting mechanism is not reversible, the user may turn the impact tool 10 over and approach a fastener with the opposite side of the output drive 16 to change rotational directions. Once again, this is possible because no portion of the drive train 14 is positioned adjacent the output drive 16 along the axis 30 (i.e., above or below the opening 44 of the output drive 16).

The impact mechanism 24 of the drive train 14 may be embodied as any type of impact mechanism. In the illustrative embodiment of FIGS. 1 and 2, the impact mechanism 24 is a ball-and-cam-type impact mechanism. The impact mechanism 24 includes a cam shaft 32 coupled to a spur gear 34 for rotation with the spur gear 34 about the axis 28. The hammer 26 of the impact mechanism 24 includes at least one hammer jaw 36. Although only one hammer jaw 36 is illustrated in FIGS. 1 and 2, it is contemplated that the hammer 26 may include two (or more) hammer jaws 36 in other embodiments. The illustrated impact mechanism 24 also includes one or more springs 38 positioned between the spur gear 34 and the hammer 26 to bias the hammer 26 away from the spur gear 34. It will be appreciated that the impact mechanism 24 may use any number of springs 38 or any other type of biasing mechanism to bias the hammer 26 along the axis 28 (downward in FIG. 1).

The drive train 14 also includes one or more struts 46 that function as an anvil of the impact mechanism 24. In the illustrative embodiment of FIGS. 1 and 2, the anvil includes two struts 46A, 46B, one for each direction of operation of the impact mechanism 24. As such, in the illustrative embodiment, the operation of the ratcheting mechanism of the output drive 16 is reversible. Each of the struts 46A, 46B includes one end 48A, 48B that is impacted by the hammer jaw 36 and another end 50A, 50B that is coupled to the ratcheting mechanism of the output drive 16 (namely, the outer ring 40). The ends 50A, 50B of the struts 46A, 46B are each coupled to the outer ring 40 by a rigid interface (e.g., a pinned joint, as shown in FIG. 2). The struts 46A, 46B may be biased in the direction of the ends 48A, 48B by a number of springs 52A, 52B or other resilient components.

In operation, the hammer 26 rotates about the axis 28 to periodically deliver an impact load to one of the two struts 46A, 46B of the anvil (depending on the direction of rotation of the hammer 26) and, thereby, cause intermittent rotation of the output drive 16. In particular, as the hammer 26 rotates about the axis 28 in a clockwise rotational direction in FIG. 2, the hammer jaw 36 will impact the end 48A of the strut 46A. This impact will be transferred by the strut 46A to the outer ring 40 of the output drive 16, causing clockwise rotation of the outer ring 40 about the axis 30. The outer ring 40 will transfer this clockwise rotation to the hex ring 42 via the ratcheting mechanism described above. The outer ring 40 (but not the hex ring 42) will then rebound due to the spring 52A biasing the strut 46A. After the hammer 26 completes a rotation about the axis 28, the hammer jaw 36 will again impact the end 48A of the strut 46A, repeating this process. When the hammer 26 rotates about the axis 28 in a counter-clockwise rotational direction in FIG. 2, the hammer jaw 36 will instead strike the end 48B of the strut 46B, driving the hex ring 42 in the counter-clockwise direction (assuming the operation of the ratcheting mechanism has been reversed). The springs 38 permit the hammer 26 to rebound after each impact, and the ball-and-cam mechanism (not shown) guides the hammer 26 to ride up around the cam shaft 32, such that the hammer jaw 36 is spaced axially from the struts 46A, 46B. As such, the hammer jaw 36 is permitted to rotate past the ends 48A, 48B of the struts 46A, 46B after the rebound. In some embodiments, the strut 46A or the strut 46B that is not being used to drive the output drive 16 may be moved out of the path of the hammer jaw 36.

Figure 3:
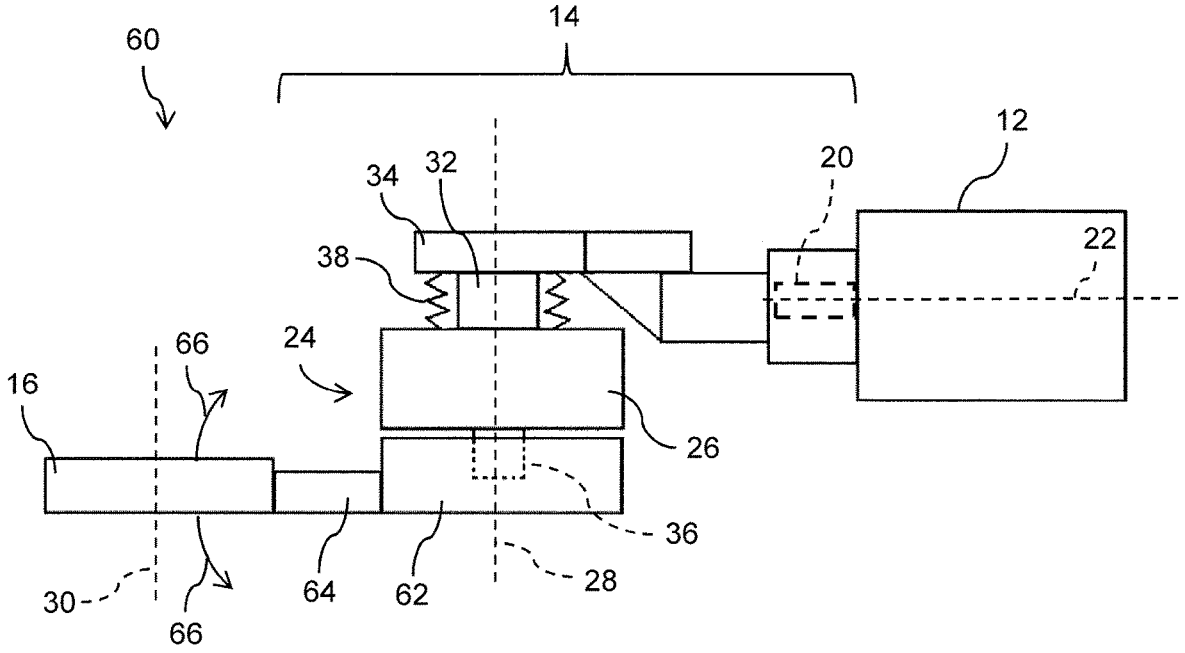
FIG. 3 illustrates a side view of a motor, a drive train, and an output drive of another embodiment of an impact tool.
Figure 4:
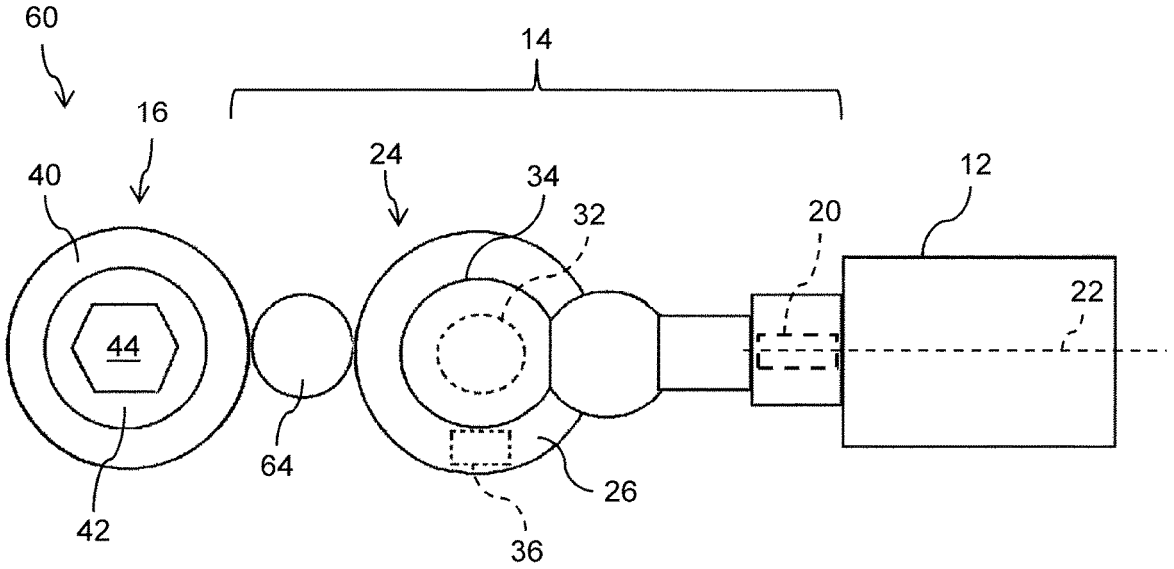
FIG. 4 illustrates a top view of the motor, the drive train, and the output drive of the impact tool of FIG. 3.

Referring now to FIGS. 3 and 4, simplified diagrams are shown of another illustrative embodiment of an impact tool 60. In particular, FIGS. 3 and 4 illustrate a motor 12, a drive train 14, and an output drive 16 of the impact tool 60. It will be appreciated that the impact tool 60 will generally include additional components (e.g., a housing supporting the motor 12, the drive train 14, and the output drive 16), which are not shown in FIGS. 3 and 4 for clarity of description. As shown in FIGS. 3 and 4, and further described below, the motor 12 includes an output shaft 20 that rotates about an axis 22, the drive train 14 includes an impact mechanism 24 having a hammer 26 that rotates about an axis 28, and the output drive 16 rotates about an axis 30. The illustrative embodiment of the impact tool 60 is depicted in FIGS. 3 and 4 with the axis 30 being parallel to and spaced apart from the axis 28 and with the axes 28, 30 both being perpendicular to the axis 22. As will be described below, however, the output drive 16 of the illustrative embodiment of the impact tool 60 is pivotable relative to the drive train 14 such that the axis 30 is positionable at a plurality of angles relative to the axis 22.

Except as noted below, the components of the impact tool 60 may be similar to the components of the impact tool 10 described above (e.g., the motor 12, the drive train 14, the output drive 16, and parts thereof). For instance, the motor 12 of the impact tool 60 may be embodied as any suitable prime mover. The drive train 14 of the impact tool 60 may include any number and/or types of devices suitable for transferring rotational motion of the output shaft 20 of the motor 12 to the output drive 16. The output drive 16 of the impact tool 60 may be embodied as any device(s) suitable for transferring rotational motion of the output drive 16 to a fastener. Like the impact tool 10, when the drive train 14 of the impact tool 60 is driven by the output shaft 20 of the motor 12, the drive train 14 in turn drives rotation of the output drive 16 about the axis 30 (allowing the output drive 16, in turn, to tighten or loosen a fastener).

The impact mechanism 24 of the impact tool 60 is similar to that of impact tool 10, except that the impact mechanism 24 of the impact tool 60 includes an anvil 62 that rotates about the axis 28 when impacted by the hammer 26 (rather than the struts 46). In particular, the hammer jaw 36 of the hammer 26 periodically delivers an impact load to one or more anvil jaws (not shown) on the interior of the anvil 62 and, thereby, causes intermittent rotation of the anvil 62 about the axis 28. The springs 38 permit the hammer 26 to rebound after each impact, and the ball-and-cam mechanism (not shown) guides the hammer 26 to ride up around the cam shaft 32, such that the hammer jaw 36 is spaced axially from the anvil 62. As such, the hammer jaw 36 is permitted to rotate past the anvil jaws of the anvil 62 after the rebound. In the illustrative embodiment, an outer surface of the anvil 62 includes gear teeth that mesh with an idler gear 64.

The output drive 16 of the impact tool 60 includes an outer ring 40 and a hex ring 42 (or an interchangeable hex insert 42). Unlike the output drive 16 of the impact tool 10, however, the output drive 16 of the illustrative embodiment of the impact tool 60 does not include a ratcheting mechanism. Rather, the hex ring 42 (or the interchangeable hex insert 42) is engaged directly with the outer ring 40. The outer ring 40 of the output drive 16 of the impact tool 60 also includes gear teeth that mesh with the idler gear 64. As such, when the anvil 62 is driven by the hammer 26, the anvil 62 drives the idler gear 64, which in turn drives the outer ring 40 of the output drive 16. As such, the illustrative embodiment of the impact tool 60 is able to achieve high no-load speeds at the hex ring 42.

In the illustrative embodiment, the output drive 16 of the impact tool 60 is pivotable relative to the drive train 14, as indicated by the arrows 66 in FIG. 3. As such, in addition to being positionable parallel to the axis 28, the axis 30 is also positionable at various angles relative to the axis 30. The gear teeth of both the idler gear 64 and the outer ring 40 of the output drive 16 are configured to remain meshed with one another, even when the output drive 16 of the impact tool 60 is pivoted relative to the drive train 14. In one embodiment, the gear teeth of both the idler gear 64 and the outer ring 40 of the output drive 16 may have curved profiles to enable this pivoting movement. It is contemplated that, in other embodiments, other mechanisms may be used to allow pivoting of the output drive 16 relative to the drive train 14 while maintaining coupling between the drive train 14 and the output drive 16.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. An impact tool comprising:

a motor including an output shaft configured to rotate about a first axis; and a drive train driven by the output shaft of the motor and to drive rotation of an output drive about a second axis that is non-parallel to the first axis;

wherein the drive train includes an impact mechanism comprising a hammer that rotates about a third axis to periodically deliver an impact load to an anvil, the third axis being parallel to and spaced apart from the second axis;

wherein the output drive comprises a ratcheting mechanism;

wherein the anvil comprises a first strut having a first end and a second end opposite the first end, the first end being configured to be impacted by the hammer when the hammer rotates about the third axis in a first rotational direction and the second end being coupled to the ratcheting mechanism, such that the first strut causes rotation of the output drive about the second axis in the first rotational direction when the first strut is impacted by the hammer; and wherein the anvil further comprises a second strut having a first end and a second end opposite the first end, the first end being configured to be impacted by the hammer when the hammer rotates about the third axis in a second rotational direction and the second end being coupled to the ratcheting mechanism, such that the second strut causes rotation of the output drive about the second axis in the second rotational direction when the second strut is impacted by the hammer.

2. The impact tool of claim 1, wherein the impact mechanism includes a spring that biases the hammer axially along the third axis toward the anvil.

3. The impact tool of claim 1, wherein no portion of the hammer or the anvil intersects the second axis.

* * * * *